US006176032B1

(12) United States Patent
Cohen et al.

(10) Patent No.: US 6,176,032 B1
(45) Date of Patent: Jan. 23, 2001

(54) DEVICE FOR PREVENTING THE ACCIDENTAL DISCHARGE OF A BULLET FROM A FIREARM

(75) Inventors: Michael Cohen; Yehoshua Altman, both of Kibbutz Kfar Etzion (IL)

(73) Assignee: Mofet Etzion Agricultural Association Ltd. (IL)

( * ) Notice: Under 35 U.S.C. 154(b), the term of this patent shall be extended for 0 days.

(21) Appl. No.: 09/226,995

(22) Filed: Jan. 7, 1999

(30) Foreign Application Priority Data

Jan. 9, 1998 (IL) ..... 122886

(51) Int. Cl.[7] ..... F41A 21/26; F41A 21/32; F41A 35/04

(52) U.S. Cl. ..... 42/96; 89/14.5

(58) Field of Search ..... 89/14.5; 102/483, 102/485; 42/96

(56) References Cited

U.S. PATENT DOCUMENTS

| | | | | |
|---|---|---|---|---|
| 3,243,909 | | 4/1966 | Kotikov | 42/105 |
| 3,439,615 | * | 4/1969 | Forman et al. | 102/485 |
| 3,664,263 | | 5/1972 | Driscoll | 102/485 |
| 3,677,132 | * | 7/1972 | Plenge | 89/14.2 |
| 3,690,026 | | 9/1972 | Rose | 42/77 |
| 3,934,513 | | 1/1976 | Gabriels | 102/485 |
| 4,013,011 | * | 3/1977 | Gabriels | 102/485 |
| 4,100,693 | * | 7/1978 | Cech | 42/96 |
| 4,448,129 | | 5/1984 | Gabriels | 102/487 |
| 4,567,831 | * | 2/1986 | Gordon et al. | 102/485 |
| 4,747,349 | * | 5/1988 | Schilling et al. | 102/485 |
| 4,777,753 | * | 10/1988 | Stancato | 102/485 |
| 4,829,877 | | 5/1989 | Zerega | 89/14.5 |
| 5,325,758 | * | 7/1994 | Compton et al. | 89/14.5 |
| 5,349,906 | * | 9/1994 | Devaux et al. | 102/485 |
| 5,377,438 | * | 1/1995 | Sheinfeld et al. | 42/96 |
| 5,463,930 | * | 11/1995 | Bisping et al. | 89/14.5 |
| 5,574,245 | * | 11/1996 | Buc et al. | 102/485 |
| 5,669,172 | * | 9/1997 | Goral | 42/96 |
| 6,026,728 | * | 2/2000 | Guhring et al. | 89/14.5 |

FOREIGN PATENT DOCUMENTS

| | | | | |
|---|---|---|---|---|
| 101271 | * | 5/1898 | (DE) . | |
| 3714867 | * | 11/1988 | (DE) . | |
| 2515808 | * | 5/1983 | (FR) | 102/485 |
| 2543284 | * | 7/1984 | (FR) | 102/485 |
| WO 93/13382 | * | 7/1993 | (WO) | 102/485 |

* cited by examiner

*Primary Examiner*—Darren W. Ark
(74) *Attorney, Agent, or Firm*—Townsend and Townsend and Crew LLP

(57) ABSTRACT

A device for preventing the accidental discharge of a bullet from a firearm, suitable for use with blank cartridges, the device including an attachment member adapted to engage the muzzle end of a firearm barrel, a substantially tubular body having a cavity and coaxially attachable at one of its ends to the barrel via the attachment member, a bullet-pierceable insert having a portion traversing the axis of the barrel and tubular body, an impact disk slidably disposed in the cavity of the tubular body, and an energy-absorbing and storing unit interposed in the tubular body between the impact disk and an abutting element, acting on the impact disk to maintain contact with the insert inside the body, wherein, upon the discharge of a bullet, the bullet pierces the insert and hits the impact disk, transferring some of its kinetic energy to the energy-absorbing and storing unit and is thereby prevented from being discharged from the firearm.

9 Claims, 1 Drawing Sheet

DEVICE FOR PREVENTING THE ACCIDENTAL DISCHARGE OF A BULLET FROM A FIREARM

FIELD OF THE INVENTION

The present invention relates to a device for preventing the accidental discharge of a bullet from a firearm. More particularly, the present invention relates to a device for preventing the accidental discharge of a bullet, suitable for use with blank or drill cartridges.

BACKGROUND OF THE INVENTION

The problem of firearm-caused accidents due to the accidental discharge of bullets is a serious one, particularly in the armed forces, and has found no real solution beyond warning and disciplinary efforts, the effects of which are unfortunately rather limited. The basic cause of these accidents is obviously the "cartridge in the chamber," which devolves the entire responsibility for safety upon the slender shoulders of the safety catch, which cannot always be relied upon under field conditions. Still, while the "cartridge in the chamber" is regarded as a serious breach of discipline under ordinary circumstances such as basic training and routine guard duties, the loaded chamber cannot be avoided in certain security operations, such as patrolling in hostile territory, and the like. This problem is even more compounded when blank cartridges are used during training or field exercises and a real, or "live," cartridge is accidentally loaded.

There are known devices utilizable with blank cartridges for facilitating the cocking of a firearm; such devices are attached to the barrel of the firearm by means of a screw traversing the barrel for the purpose of arresting the gases produced when a cartridge is fired. Such devices pose a real danger to the user and to the firearm itself, in the event that the firearm's magazine was loaded with a "live" cartridge and a bullet is accidentally fired, hitting the screw.

SUMMARY OF THE INVENTION

It is one of the objects of the present invention to offer a solution to the above problems by providing a device attachable to various types of firearms: single-shot, semi-automatic and automatic, which will prevent the discharge of a bullet from the firearm without causing any damage thereto.

It is a further object of the present invention to provide such a device which is especially suitable for use with blank cartridges.

According to the invention, the above objects are achieved by providing a device for preventing the accidental discharge of a bullet from a firearm, suitable for use with blank cartridges, said device comprising attachment means adapted to engage the muzzle end of a firearm barrel, a substantially tubular body having a cavity and coaxially attachable at one of its ends to said barrel via said attachment means, a bullet-pierceable insert having a portion traversing the axis of said barrel and tubular body; an impact disk slidably disposed in the cavity of said tubular body, energy-absorbing and storing means interposed in said tubular body between said impact disk and an abutting means, acting on said impact disk to maintain contact with said insert inside said body, wherein, upon the discharge of a bullet, said bullet pierces said insert and hits said impact disk, transferring some of its kinetic energy to said energy-absorbing and storing means, and is thereby prevented from being discharged from said firearm.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
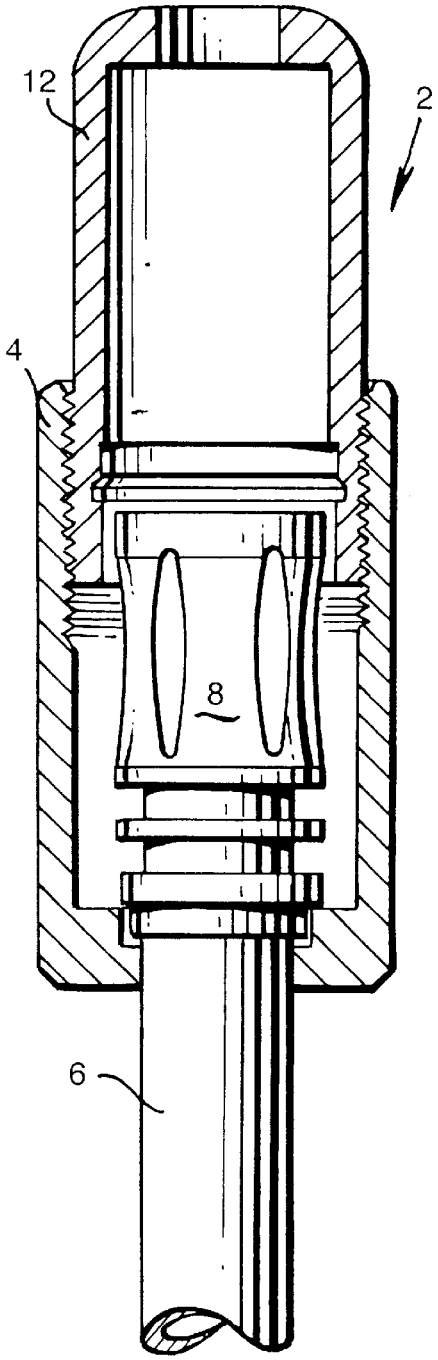
FIG. 1 is a cross-sectional view of the device (without details) according to the invention for preventing the accidental discharge of a bullet from a firearm, shown attached to a rifle barrel having a flash suppressor attached at the end thereof.
Figure 2:
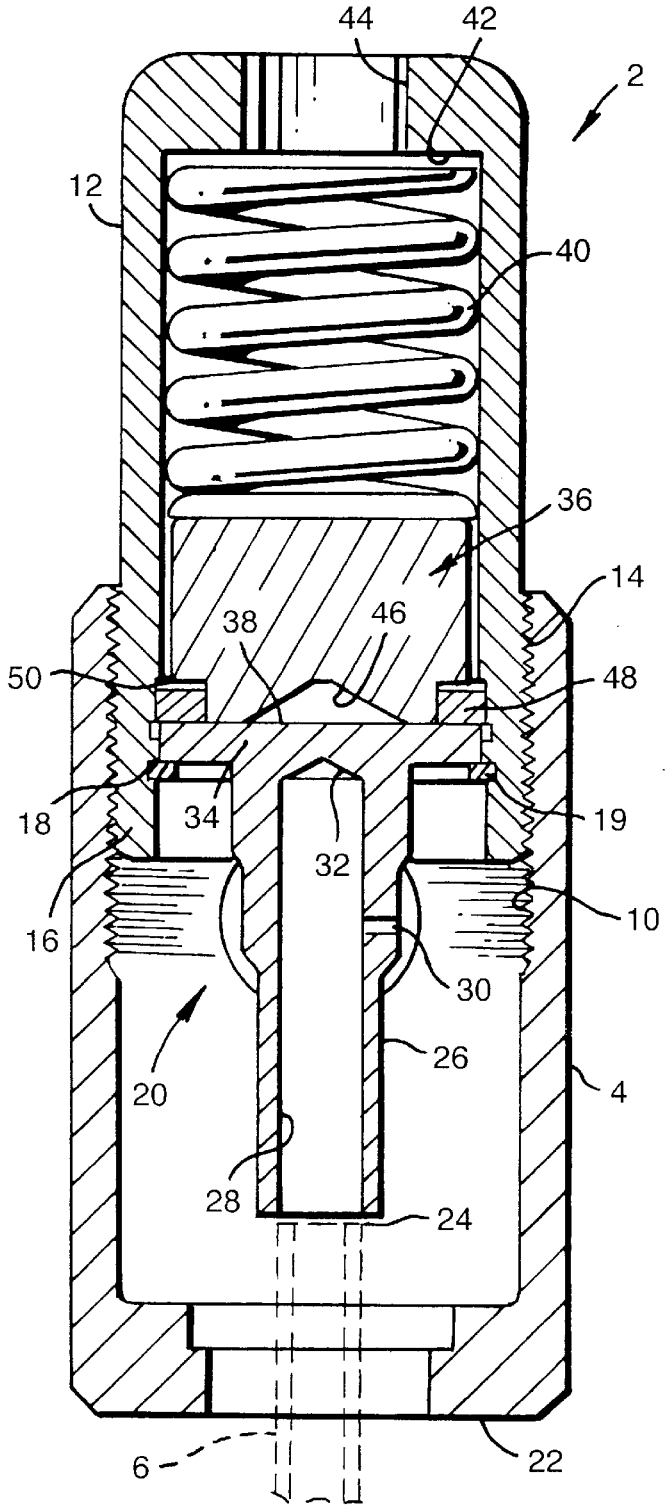
FIG. 2 is a cross-sectional view of a preferred embodiment of the device of FIG. 1.

Referring now to the drawings, there is shown a preferred embodiment of a device 2 for preventing the accidental discharge of a bullet from a firearm, utilizable with blank cartridges, including a sleeve 4 for attaching the device to the muzzle end of a firearm barrel 6 by means of a standard flash suppressor 8 screwed thereon. The sleeve 4 is provided with an internal thread 10 for engagement with a tubular body 12 having an external thread 14 on one of its end portions 16. Inside the body 12 there is formed a peripheral groove 18 for retaining the outer periphery of a resilient ring 19, said ring forming an abutment shoulder for holding a T-shaped insert 20. Insert 20 extends along the axis of sleeve 4, ending short of its lower end 22 (when assembled on a firearm) so as to facilitate the abutment therewith of the upper edge 24 of barrel 6. The leg portion 26 of insert 20 has a bore 28 greater than the size of the barrel's bore, and further includes a through-going hole 30 for allowing controlled release of gases, soot and gunpowder.

Bore 28 advantageously ends with a conical recess 32 cutting into the upper portion 34 of the insert. An impact disk 36 presses against the outside surface 38 of insert upper portion 34 by means of a helical compression spring 40, the other end of which bears against the inside surface 42 of tubular body 12, in which there is provided a central hole 44 having a diameter at least somewhat exceeding the caliber of the firearm with which the device is to be used. The impact disk 36 may advantageously be provided with a conical recess 46 on its surface facing the outside surface 38 of insert 20. An adjustment washer 48 is advantageously interposed between impact disk 36 and insert 20, abutting against shoulder 50 formed along the lower inside portion of body 12. Shoulder 50 limits the movement of insert 20 and of the impact disk 36 caused by the gases of the fired blank cartridges and by the impact of a bullet, thus assuring proper operation of the firearm's cocking mechanism.

In use, when the device 2 is in position as shown in FIG. 1 and a blank cartridge is fired, the discharged gases exiting from barrel 6 enter the closed end bore 28 of insert 20, and thus are utilized to re-cock the firearm, facilitating the next shot. When, however, a bullet is accidentally fired, it will hit the recess 32, pierce through the material of the upper portion of insert 20, impact disk 36, and, while compressing spring 40, will be prevented from being discharged from the firearm.

When a further bullet is fired, it will freely pass through the remainder of the impact disk 36. Hence, in order to make the firearm safe again, body 12 has to be reassembled, and the pierced insert 20 and impact disk 36 have to be replaced with new ones, or, alternatively, the entire device has to be replaced.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for preventing the accidental discharge of a bullet from a firearm, suitable for use with blank cartridges, said device comprising:

attachment means adapted to fixedly engage the muzzle end of a firearm barrel;

a substantially tubular body having a cavity and coaxially attachable at one of its ends to said barrel via said attachment means;

a bullet-pierceable insert having a portion traversing said tubular body and also the axis of said barrel when the tubular body is attached to said barrel;

said insert being made of a non-combustible material, for trapping gases exiting from said barrel when blank cartridges are fired, thereby causing re-cocking of the firearm;

an impact disk slidably disposed in the cavity of said tubular body, and energy-absorbing and storing means interposed in said tubular body between said impact disk and an abutting means, acting on said impact disk to maintain contact with said insert inside said body, wherein, upon the discharge of a bullet, said bullet pierces said insert and hits said impact disk, transferring some of its kinetic energy to said energy-absorbing and storing means, and is thereby prevented from being discharged from said firearm.

2. The device as claimed in claim 1, wherein said energy-absorbing and storing means is a helical compression spring freely fitting in said cavity in said tubular body and having an internal diameter exceeding the caliber of said firearm.

3. The device as claimed in claim 1, wherein said insert is T-shaped, having a tubular leg portion defining a cavity and an upper portion extending from said leg portion traversing the axis of said barrel when the tubular body is attached to said barrel, wherein the leg portion is sized so that a free end thereof is capable of contacting said muzzle end of said firearm barrel.

4. The device as claimed in claim 3, wherein the cavity of said tubular leg portion has a diameter greater than the diameter of the barrel of the firearm with which the device is to be used.

5. The device as claimed in claim 3, wherein said leg portion is provided with a hole, allowing the escape of gases, soot and gunpowder therethrough.

6. The device as claimed in claim 1, further comprising a resilient ring partly seated in a peripheral groove in the inside surface of a lower end of said tubular body, said ring forming an abutment shoulder for holding said insert.

7. The device as claimed in claim 1, further comprising an adjustment washer interposed between said impact disk, said insert and a shouldered inside surface of said tubular body, thereby limiting the movement of said insert and impact disk in a direction away from the muzzle end as a result of the gases acting on said insert upon firing of a blank cartridge.

8. The device as claimed in claim 1, wherein said attachment means is configured to be engaged and held in position by a firearm's flash suppresser.

9. The device as claimed in claim 1, wherein said attachment means and said tubular unit are detachably connected to each other by means of threads.

* * * * *